United States Patent [19]

Mori

[11] Patent Number: 4,777,701

[45] Date of Patent: Oct. 18, 1988

[54] COILER DEVICE IN A SPINNING MACHINE

[75] Inventor: Kaname Mori, Gifu, Japan

[73] Assignee: Kabushikikaisha Hara Shokki Seisakusho, Gifu, Japan

[21] Appl. No.: 10,194

[22] PCT Filed: May 6, 1986

[86] PCT No.: PCT/JP86/00231

§ 371 Date: Dec. 31, 1986

§ 102(e) Date: Dec. 31, 1986

[87] PCT Pub. No.: WO86/06706

PCT Pub. Date: Nov. 20, 1986

[30] Foreign Application Priority Data

May 4, 1985 [JP] Japan ..... 60-94583

[51] Int. Cl.[4] ..... B65H 54/76; B65H 54/80; D04H 11/00

[52] U.S. Cl. ..... 19/159 R

[58] Field of Search ..... 19/159 R

[56] References Cited

U.S. PATENT DOCUMENTS

| | | | |
|---|---|---|---|
| 3,141,201 | 7/1964 | Gasser | 19/159 R |
| 3,324,515 | 6/1967 | West | 19/159 R |
| 3,470,587 | 10/1969 | Kincaid | 19/159 R |
| 4,646,390 | 3/1987 | Bothner | 19/159 R |

FOREIGN PATENT DOCUMENTS

| | | | |
|---|---|---|---|
| 46-20805 | 7/1971 | Japan | 19/159 R |
| 46-31943 | 11/1971 | Japan | 19/159 R |
| 51-03214 | 1/1976 | Japan | 19/159 R |

*Primary Examiner*—Louis K. Rimrodt

*Attorney, Agent, or Firm*—Burns, Doane, Swecker & Mathis

[57] ABSTRACT

An improved coiler device of a spinning machine, wherein a downstream portion of a coiler tube is further bent downward at a position adjacent to a place where a sliver exits, a flange extending upward is arranged in a coiler wheel side of a coiler plate, whereby an exit opening of the coiler tube is formed from a bottom face of the coiler wheel to the flange, and the coiler plate is movably constituted so that a relative speed of an inside face of the flange to that of the coiler tube is lower than a moving speed of the coiler tube.

4 Claims, 3 Drawing Sheets

COILER DEVICE IN A SPINNING MACHINE

TECHNICAL FIELD

This invention relates to a coiler device in a spinning frame, more particularly, to a coiler device having an improved coiler tube and used in a spinning machine.

BACKGROUND ART

Generally, a can is used as means for transferring a sliver to a next process in a spinning factory. To prevent degradation of the quality of the sliver and to accommodate many slivers in the can, the slivers delivered from a calender roller arrive through the coiler tube in a coiler wheel and are coiled by the coiler wheel to fit the sliver into the can.

Recently, the spinning speed in a spinning machine such as a card, a drawing frame or the like has been increased to increase production. Also, the variety of the fibers constituting the sliver has increased, so that, for example, a sliver having a different surface frictional characteristic from that of a conventional sliver, or a sliver constituted of fibers having a different stiffness from that of a conventional fiber are used. Therefore, a coiler device wherein a change is made only in the shape of the exit opening of the coiler tube arranged on a bottom face of the coiler wheel, as in a conventional improved coiler device, cannot sufficiently cope with the increased speed of the spinning machine and the variety of the fibers constituting the sliver.

Further, a coiler device 6 in which a coiler tube 61 extends in a straight line toward a coiler wheel, as shown in FIG. 4, has been widely used as a coiler device of a conventional spinning machine. In this coiler device, there is little possibility of the sliver advancing in a sliver passage in the coiler tube 61 blocking an exit opening of the coiler tube. However, when this coiler device is rotated at a high speed, a force of inertia frequently causes the sliver to overflow from the can. Even if the sliver does not overflow from the can, it is probable that the quality of the sliver will be degraded by abrasion of the sliver against an inner wall of the can.

Several attempts have been made to solve the above-mentioned problems. For example, in a coiler device 7 shown in FIG. 5, a sliver guiding part 73 extending upward from a coiler wheel 72 and changing the moving direction of a sliver is secured in a top end of a coiler tube 71. Therefore, when the sliver advancing in the coiler tube 71 enters a sliver passage 75, the advancing direction of the sliver is changed to a downward direction by an outside portion of an inner wall 74. By using this coiler device, it is possible to prevent the phenomenon of sliver overflow from the can, and the phenomenon of abrasion of the sliver by the inner wall of the can. However, this coiler device has the following disadvantage. Namely, in this coiler device 7, when the sliver is broken between the calender roller and the exit opening of the coiler tube upon an exchange of cans, a top end of the sliver to be supplied into a new can collides with the outside portion of the inner wall 74, so that the sliver frequently blocks the sliver guiding part 75. Further, since the sliver is folded in the sliver guiding part 75 in an ordinary operation, the folded portion of the sliver comes into contact with the outside portion of the inner wall 74, so that the sliver frequently blocks in the sliver guiding part 75.

DISCLOSURE OF THE INVENTION

An object of the present invention is to eliminate the above-mentioned problems of the known coiler device and to provide a coiler device capable of smoothly accommodating a sliver in a coiling state into a can without an overflow of the sliver from a can upon a normal operation of the coiler device and blocking of the sliver in a coiler tube upon a starting operation and during the normal operation of the coiler device.

The object of the present invention is achieved by a coiler device of a spinning machine comprised of a coiler plate and a coiler wheel mounted rotatably in the coiler plate, said coiler wheel being provided with a coiler tube for guiding a sliver, characterized in that a flange extending upward is arranged in a coiler wheel side of the coiler tube, a downstream portion of the coiler tube that is inclined downward is bent further downward at a position near to a sliver exit, an exit opening of the sliver tube is formed from a bottom face of the coiler wheel to the flange of the coiler plate, an inside face of the flange forming an outside circumferential wall of the exit opening of the coiler tube, and the coiler plate is stationary or movably constituted in such a manner that relative speed of the inside face of the flange to the coiler tube is lower than a moving speed of the coiler tube, which speed is substantially defined as a rotational speed of a center of the exit opening of the coiler tube.

In the coiler device in accordance with the present invention, the downstream portion of the coiler tube is bent downward. Further, the exit opening of the coiler tube is formed from the bottom face of the coiler wheel to the flange of the coiler plate, and the inside face of the flange operates as the outside circumferential wall of the sliver moving in the coiler tube. Since the direction of movement of the sliver is changed to be almost vertical by the two above-mentioned constitution, the sliver is prevented from overflowing from a can.

Also, since the coiler device is constituted such that the outer circumferential wall of the coiler plate moves more slowly than the moving speed of the coiler tube, the top end of the sliver moving in the coiler tube is more rapidly exhausted from the exit opening of the coiler tube by contact between the sliver and the outer circumferential wall and an air current accompanying the outer circumferential wall, so that a blocking of the sliver in the coiler tube can be prevented. Therefore, this constitution is useful to prevent the blocking of the sliver caused by a folded portion of the sliver.

The coiler plate can be stopped or the coiler plate rotated in the same or a reverse direction of the rotation of the coiler wheel. If the coiler device is constituted such that relative speed of the inside face of the flange to the coiler tube is lower than a moving speed of the coiler tube, the relative arrangement of the coiler plate and the coiler wheel can be optionally selected.

Preferably, a top end of a sliver leading groove arranged adjacent to the exit opening of the coiler tube extends in a moving direction of the sliver in the bottom face of the coiler wheel. If the sliver leading groove having the top end thereof extended in the bottom face of the coiler wheel is provided, since the sliver exhausted from the coiler tube advances through the sliver leading groove, ingress of the sliver between the coiler wheel and the inside face of the flange can be prevented.

The coiler plate and the coiler wheel move relative to each other, and in this situation, the fibers of the sliver could be inserted in a gap between the coiler plate and the coiler wheel by an air current passing through this gap. Therefore, preferably an intercepting portion extending from the flange or the top end of the coiler tube to the opposite portion thereof is provided to close the gap. This intercepting portion may be formed as one body associated with the top end of the downstream portion of the coiler tube or one body associated with the flange of the coiler plate.

Since the coiler device in accordance with the present invention has the constitution described hereinbefore, it is possible to prevent overflowing of the sliver from the can caused during high speed rotation of the coiler device and the blocking of the sliver in the coiler tube upon a starting operation or during a normal operation of the coiler device, by using the coiler device in accordance with the present invention, and further, it is possible to apply a smooth coiling motion to the sliver.

BEST MODE FOR CARRYING OUT THE INVENTION

To facilitate understanding of the present invention, the coiler device in accordance with the present invention is described in detail with reference to the attached drawings.

Figure 1:
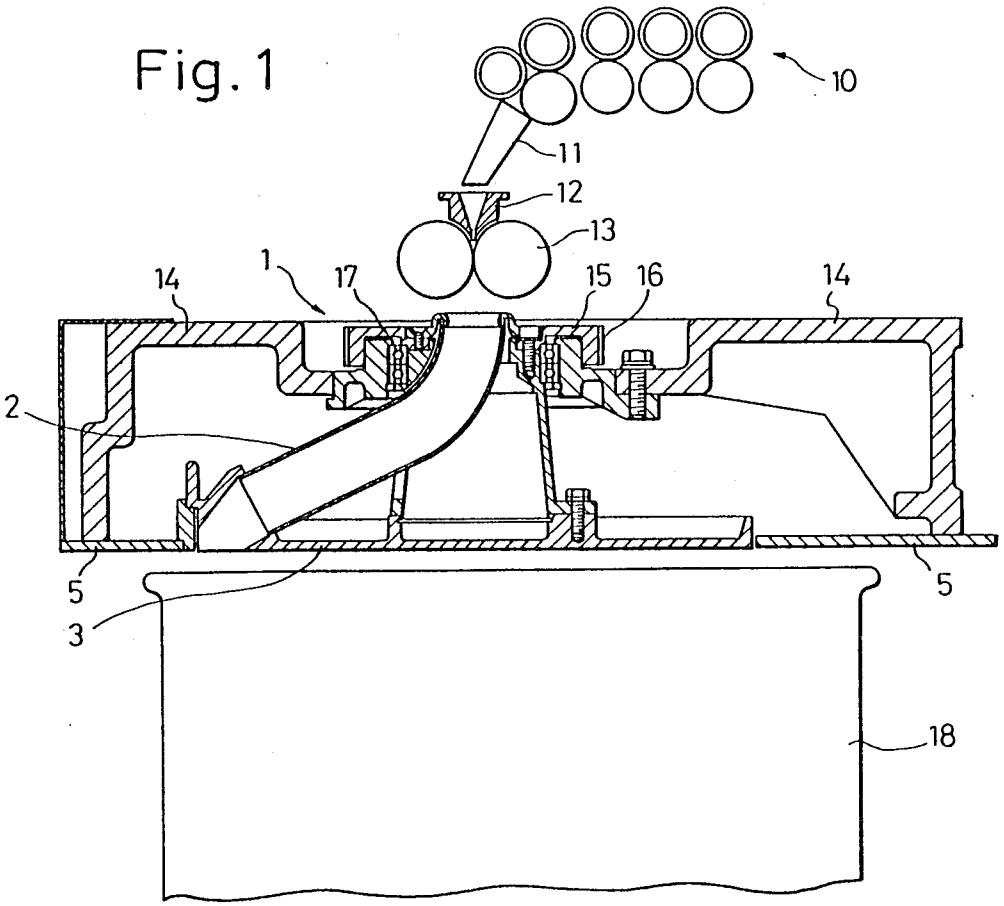
FIG. 1 is a vertical sectional view illustrating an embodiment of a coiler device in accordance with the present invention, which coiler device is arranged on a drawing frame.

An embodiment of the coiler device in accordance with the present invention, which coiler device is arranged on a drawing frame, is shown in FIG. 1.

As shown in FIG. 1, a coiler device 1 is comprised of a coiler wheel 3 and a coiler plate 5 arranged on an outside of the coiler wheel 3. The coiler plate 5 in this embodiment is fixed to a frame 14 of the drawing frame. A coiler tube 2 is connected to an upper portion of the coiler wheel 3. An upper portion of the coiler tube 2 is rotably mounted on the frame 14 of the drawing frame by means of a bearing 17 and is fixed with a pulley 15 to be driven. The coiler wheel 3 is rotated by rotating the pulley 15 by a driving belt 16. A sliver (not shown) delivered from a drafting zone 10 of the drawing frame is supplied through a gatherer 11 and a trumpet 12 to a calender roller 13, the sliver delivered from the calender roller 13 is supplied to the coiler tube 2 of the coiler device, and the coiler tube 2 rotates with the coiler wheel 3. The sliver is withdrawn from the coiler tube 2 by rotation of a can 18 arranged below the coiler device to accommodate the sliver in a coiled state into the can 18. Since the above-mentioned mechanisms are well-known, a detailed description thereof is omitted.

Figure 2:
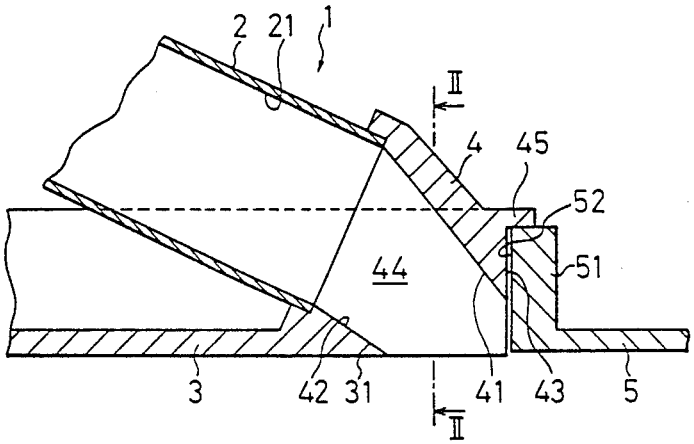
FIG. 2 is a partially sectional view illustrating a lower portion of the coiler device shown in FIG. 1.

In the embodiment of the coiler device 1 in accordance with the present invention and shown in FIG. 2, a sliver guiding member 4 is provided on a downstream end of the coiler tube 2. This sliver guiding member 4 is integrated as one body with the coiler wheel 3. An upper inside wall 41 of the sliver guiding member is formed such that inclination of a circular inside wall 21 of the coiler tube 2 is further inclined in the downward direction in a place where the sliver guiding member is arranged, while a lower inside wall 42 of the sliver guiding member is formed with an inclination similar to the inclination of the circular inside wall 21 of the coiler tube 2 or with a slightly more downward inclination than that of the circular inside wall 21 of the coiler tube 2. A flange 51 is provided on a coiler wheel side of the coiler plate 5. Further, a lower end of an upper inside wall of the sliver guiding member extends toward an inside face near to the coiler wheel 3 of the flange 51, i.e. an outer circumferential wall 52, as shown in FIG. 2. Therefore, an exit opening of the tube wheel 2 is formed from a bottom face 31 of the coiler wheel to the flange 51 of the coiler plate 5.

Since the coiler device in accordance with the present invention is provided with the sliver guiding member 4, the inclination of the sliver moving from an up stream position to a downstream position in a sliver passage 44 is moved downward by the upper inside wall 41 and further moved in a substantially down direction by the outer circumferential wall 52, so that the sliver does not overflow from the can. Further, since the coiler device is constituted such that a rotational speed of a center of the exit opening of the coiler tube of the coiler wheel is faster than the outer circumferential wall 51, the sliver striking the outer circumferential wall 52 is affected by frictional action applied from the outer circumferential wall 52 and/or the action caused by an air current accompanying the outer circumferential wall 52 such that the advancing speed of the sliver becomes slower than that of the coiler wheel 3, whereby the sliver is positively withdrawn from the coiler tube 2, so that the blocking of sliver in the coiler tube is prevented.

Figure 3:
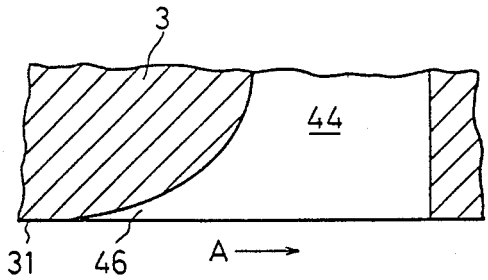
FIG. 3 is a sectional view of the coiler device taken along the line II—II of FIG. 2.
Figure 4:
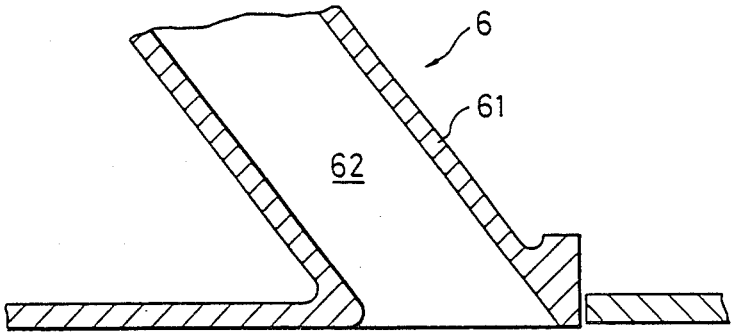
Fig. 4 PRIOR ART
FIG. 4 is a vertical sectional view illustrating a lower portion of a conventional known coiler device.
Figure 5:
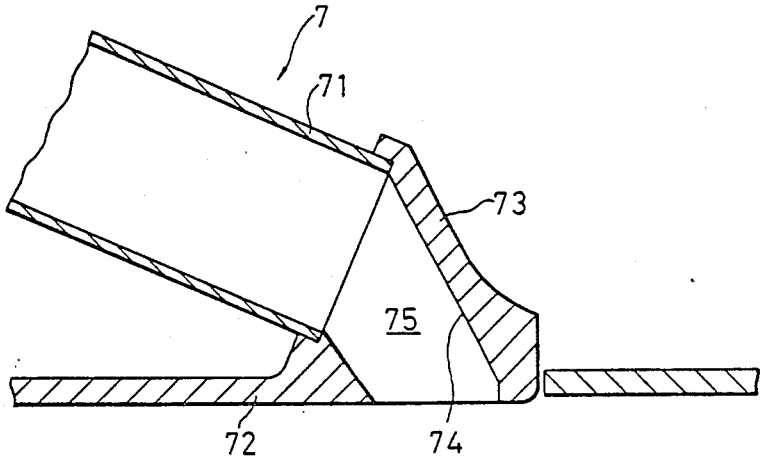
Fig. 5 PRIOR ART
FIG. 5 is a vertical sectional view illustrating a lower portion of another conventional known coiler device.

A sectional view of the coiler device taken along the line II—II of FIG. 2 is shown in FIG. 3. In FIG. 3, A indicates a rotational direction of the coiler wheel 3. As shown in FIG. 3, a sliver leading groove 46 is provided facing a direction opposite to a rotation direction of the coiler wheel 3, i.e., a moving direction of the sliver against the coiler wheel 3, in the bottom face 31 of the coiler wheel 3. Therefore, the sliver advancing in the sliver passage 44 is led to the sliver leading groove 46, so that there is no possibility of the sliver entering a gap between an outer side face 43 of the sliver guiding member 4 and an inside face 52 of the flange 5 (a lower portion of which constitutes the above-mentioned outer circumferential wall for the sliver).

When the gap between the outer side face 43 of the sliver guiding member 4 and the inside face 52 of the flange 5 is 0.3 mm or more, the coiling state becomes good. If the gap is extremely narrow, fibers in the sliver enter the gap and are cut. If there is a suitable gap, fibers having a tendency to be inserted between the gap are also withdrawn without disarray of the sliver, by movement of the sliver.

To prevent air leaks from the gap to an atmosphere, an intercepting portion 45 extends from the sliver guiding member 4 to a place over the flange 51. This intercepting portion may be constituted such that the intercepting portion extends from the flange 51 to a place over the sliver guiding member 4. By arranging the intercepting portion as described hereinbefore, the fibers constituting the sliver are prevented from entering the gap and flys in the atmosphere are prevented from entering the coiler device.

In the embodiment shown in FIG. 2, the sliver guiding member 4 is formed as a separate member from the coiler tube 2 and is connected to the coiler tube 2, However, the coiler tube 2 and the sliver guiding member 4 may be made as one continuous body. Further, the flange 51 of the coiler wheel 5 in the embodiment shown in FIG. 2 is provided in a vertical position, but a direction of the outer circumferential wall 52 of the flange 51 is not limited to the vertical direction and the flange having the outer circumferential wall inclined toward an inner side or an outer side may be provided.

I claim:

1. A coiler device of a spinning machine comprising a coiler plate and a coiler wheel mounted rotatably on the coiler plate, said coiler wheel being provided with a coiler tube for guiding a silder, said coiler plate having a flange extending upwardly from a coiler wheel side of the coiler plate, a downstream downwardly inclining portion of the coiler tube being inclined further downward at a position adjacent to a place where a sliver exists, an exit opening of the sliver tube being formed between a bottom face of the coiler wheel and the flange of the coiler plate, an inside face of the flange forming an outside circumferential wall of the exit opening of the coiler tube, said coiler plate being stationarily or movably constituted such that a speed of the inside face of the flange is low relative to that of the coiler tube where the speed of said coiler tube is substantially defined as a rotational speed of a center of the exit opening of the coiler tube.

2. A coiler device according to claim 1, further comprising s sliver leading groove provided adjacent to the exit opening of the coiler tube, a top end of the sliver leading groove extending in a moving direction of the sliver in the bottom face of the coiler wheel.

3. A coiler device according to claim 1 wherein an intercepting portion for closing a gap formed between the flange of the coiler plate and a top end of the downstream portion of the coiler tube and extending substantially in a vertical direction extends from the flange or the top end of the coiler tube to the opposite portion thereof.

4. A coiler device of a spinning machine comprising:

a coiler plate having an opening and a flange surrounding the opening, the flange including an inner circumferential surface;

a coiler wheel rotatably mounted on the coiler plate in the opening and having a bottom surface, an outer circumferential surface opposing the inner circumferential surface of the coiler plate, and a tube having an upstream portion, a downstream portion and an exit opening extending through the bottom and outer circumferential surfaces of the coiler wheel so that the exit opening is defined partially by a portion of the inner circumferential surface of the coiler plate, the tube having a first inclined section at in the downstream portion thereof which is inclined relative to the upstream portion of the tube and a further inclined section adjacent the exit opening which is inclined relative to the first inclined section.

* * * * *